US006299496B1

(12) United States Patent
Griffiths et al.

(10) Patent No.: US 6,299,496 B1
(45) Date of Patent: Oct. 9, 2001

(54) EXHAUST CONTROL SYSTEM FOR A MARINE VESSEL

(75) Inventors: John M. Griffiths, Fond du Lac; Jeffrey J. Van Asten, Kimberly, both of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/606,110

(22) Filed: Jun. 19, 2000

(51) Int. Cl.[7] ..... B63H 21/32
(52) U.S. Cl. ..... 440/89; 440/1
(58) Field of Search ..... 440/89; 60/324; 181/226

(56) References Cited

U.S. PATENT DOCUMENTS

| | | | | |
|---|---|---|---|---|
| 4,002,136 | | 1/1977 | Michalak | 115/0.5 |
| 4,586,908 | | 5/1986 | Schlichthorst | 440/89 |
| 4,643,272 | * | 2/1987 | Gaffrig | 181/260 |
| 4,773,215 | | 9/1988 | Winberg et al. | 60/324 |
| 4,995,233 | | 2/1991 | Lulloff | 60/324 |
| 5,421,756 | | 6/1995 | Hayasaka | 440/89 |
| 5,470,263 | | 11/1995 | Griffiths et al. | 440/75 |
| 5,769,628 | * | 6/1998 | Lin | 432/241 |
| 6,220,907 | * | 4/2001 | Shimizu | 440/89 |

OTHER PUBLICATIONS

Article "Sound Level Meter", Internet Source.
Article "Outdoor Noise Propagation Measurement, Modeling & Evaluation", Navcon Engineering Network.
Article "Sound Level Meter", Internet Source.
Article "Integrating soundLevel Meter", Internet Source.
Article "Digital Sound Meter", Internet Source.
Article "Decibel (dB)", Internet Source.
Article "VU Meter", Internet Source.
Article "Sound Pressure Level (SPL)", Internet Source.
Kernco Instruments Co., Inc. 2 articles on Sound Level Meters.
Articles from Radio Shack: Essential Accessories:Sound Pressure Level Meter.
2 Articles from SAE J34 DEC91 and SAE J2005 DEC91.
Phamplet from Quicksilver: Silent Choise Exhaust Silencer System.

* cited by examiner

*Primary Examiner*—Stephen Avila
(74) *Attorney, Agent, or Firm*—William D. Lanyi

(57) ABSTRACT

An exhaust control system is provided for a marine propulsion system used on a marine vessel. Several parameters are monitored by a controller and a controller uses the information provided by these sensors to control the position of a valve within an exhaust conduit assembly. Sound level is measured at a preselected position on the marine vessel and the degree of opening of a valve is controlled to limit the noise level emanating from the exhaust system. Some exhaust can be diverted directly to the atmosphere through the transom as long as the noise level does not exceed a preselected limit, which can typically be a state law regulation. If a noise level is exceeded, the controller forces the exhaust through an underwater discharge point, typically through the propeller hub of the marine propulsion system.

16 Claims, 6 Drawing Sheets

EXHAUST CONTROL SYSTEM FOR A MARINE VESSEL

BACKGROUND OF THE INVENTION

1. Field of the Invention

The present is generally related to an exhaust system for a marine vessel and, more particularly, to an improved system in which the direction of the exhaust is controlled as a function of a preselected parameter or parameters in combination with a noise measurement.

2. Description of the Prior Art

In the field of marine propulsion systems, it is well known that the exhaust from an inboard engine of a marine propulsion system can be optionally directed to an underwater outlet or an above water outlet or partially to both above water and underwater outlets. It is also well known to those skilled in the art of marine propulsion systems that underwater outlets of exhaust gases from an internal combustion engine can reduce the overall noise level emanating from the marine vessel. However, exhausting the gases from an internal combustion engine under water results in increased resistance to the flow of exhaust gases when compared to exhausting these gases at a point above the water level. Therefore, more power can be achieved by an engine in a marine vessel if the exhaust gases are not directed to an underwater outlet.

U.S. Pat. No. 4,773,215, which issued to Winberg et al on Sep. 27, 1988, discloses an exhaust control assembly for a marine stern drive system. The stem drive marine propulsion system has an inboard engine with an exhaust, an outboard drive unit operative coupled to the engine, and separated therefrom by a transom having two exhaust passages therethrough, and an exhaust control assembly aft of the engine exhaust and forward of the transom and within the boat. The assembly has an inlet connected to the engine exhaust, and has first and second outlets communicating with the respective exhaust passages extending aft through the transom. A valve in the assembly selectively controls communication of the inlet with the first outlet.

U.S. Pat. No. 4,995,233, which issued to Lulloff on Feb. 26, 1991, discloses an automatically controlled exhaust assembly for a marine stern drive system. The stem drive marine propulsion system has an inboard engine with an exhaust, an outboard drive unit and a propeller operatively coupled to the engine and separated therefrom by a transom having two exhaust passages therethrough and an exhaust control assembly having an inlet connected to the engine exhaust, first and second outlets communicating with respective exhaust passages extending aft through the transom, and a valve in the assembly having a first condition providing communication of the inlet with the first outlet and a second condition blocking communication of the inlet with the first outlet. Automatic control circuitry automatically controls actuation of the valve between the first and second conditions in response to a given parameter.

U.S. Pat. No. 4,002,136, which issued to Michalak on Jan. 11, 1977, describes a marine exhaust system. The system is intended for use on boats powered by an internal combustion engine. An exhaust chamber is located in the stern of the boat and is connected to the engine exhaust manifold. A submerged exhaust port emits exhaust gases below the water level to silence exhaust noise. The exhaust port has a recessed opening so that relative movement of water past the port assists in drawing the exhaust gases from the chamber. Atmospheric vent holes communicate the chamber with atmosphere to exhaust gases when the boat is idling or operating at slow speeds.

U.S. Pat. No. 4,586,908, which issued to Schlichthorst on May 6, 1986, describes an exhaust gas system for internal combustion engines of a ship. The exhaust gas system for a ship has at least one internal combustion engine for moving the ship through water. The exhaust gas system includes a first gas passage for conducting engine exhaust gases below the water surface and a second gas passage for conducting the engine exhaust gases above the water surface. It also includes a control valve responsive to the position of the ship in the water for determining the selection of the first gas passage or the second gas passage to conduct the exhaust gases, with a cooling member provided for the gases conducted by the first passage and having openings to the water for aspirating or passing the water through the cooling member when the ship moves through the water.

U.S. Pat. No. 5,421,756, which issued to Hayasaka on Jun. 6, 1995, describes an exhaust system for a marine propulsion machine. The exhaust gas discharge system is used on a watercraft and has a first discharge path including a first outlet primarily for use during high speed vessel operation and a second discharge path including a second outlet for use during both low and high speed vessel operation. The first outlet is arranged to constantly remain below a water surface level of a body of water in which the watercraft is operated while the second outlet is arranged to locate above the water level surface during high speed vessel operation and below the water surface at a level higher than the first outlet during idle and low speed vessel operation. Additionally, the second discharge path has an exhaust flow sectional area of a size at least as large as the exhaust flow sectional area of the first discharge path. The system is capable of discharging exhaust gases in a smooth, efficient manner, and is comprised of a relatively simple structure.

When exhaust gases are discharged below the water level of a body of water in which a marine vessel is operated, it is known that the gases can be exhausted through the propeller of the marine vessel. U.S. Pat. No. 5,470,263, which issued to Griffiths et al on Nov. 28, 1995, discloses a method and apparatus for improving reverse thrust of a marine drive. The marine drive has a reverse thrust cup on the propeller shaft between the propeller hub and the rear retaining nut. The reverse thrust cup permits the propeller hub to slide on the propeller shaft fore and aft. When the marine drive is in the forward direction the forward thrust of the propeller forces the propeller hub to the forward position thereby directing engine exhaust out the rear of the propeller hub. Conversely, when the marine drive is in the reverse direction, the rearward thrust created by the propeller hub forces the propeller hub to the rearward position thereby directing exhaust out a forward exhaust opening forward of the propeller blades increasing the reverse thrust of the marine drive.

The patents described above are hereby explicitly incorporated by reference in the description of the present invention.

When the exhaust of a marine propulsion system is exhausted directly through a transom of a boat and not toward the optional underwater discharge point, the noise levels created by the marine propulsion system can possibly exceed certain state or local ordinances and, as a result, this type of operation of a marine vessel can subject the vessel operator to fines and penalties if the noise level caused by the marine vessel exceeds the legal limits. In a typical operation of an exhaust diverter, such as that disclosed in U.S. Pat. Nos. 4,773,215 and 4,995,233, the selection between the underwater discharge and the above water discharge is made either manually or as a function of manifold pressure. The selection of an above water discharge of the exhaust can be made without any regard to the noise level that this election causes. As a result, the operator of the marine vessel can possibly be subject to fines or other penalties if the noisier option is manually selected. It would therefore be significantly beneficial if an exhaust system could be provided that controls the exhaust diverter in a way that minimizes the noise level produced by the marine vessel when operated at low speeds, allows increased noise levels at high speeds when the marine vessel is likely to be located away from populated dock areas, and also limits the maximum sound level emanating from the marine vessel regardless of the location of the vessel or its speed.

SUMMARY OF THE INVENTION

An exhaust control system for a marine vessel made in accordance with the present invention comprises a first conduit assembly which, in turn, comprises an inlet passage, a first outlet passage, and a second outlet passage. A valve is disposed within the conduit assembly for selectively blocking the first outlet passage from fluid communication with the inlet passage. A valve actuator is connected to the valve for controlling the position of the valve relative to the first outlet passage and a controller has an output signal port connected in signal communication with the valve actuator. A first sensor is connected in signal communication with the controller and located to sense a first parameter of the marine vessel. The first sensor provides a first sensor signal to the controller which is representative of the first parameter. The valve is movable to a position within the first outlet passage by the valve actuator in response to a first output signal provided by the controller at the output signal port as a function of the first sensor signal.

The inlet passage of the conduit assembly is connectable to an exhaust conduit of the engine, the first outlet passage is connectable to a first conduit extending directly through the transom of the marine vessel, and the second outlet passage is connectable to a second conduit extending through the transom and through the outboard drive mechanism of the stern drive system. The valve can be a butterfly valve and the valve actuator can be a stepper motor. The valve is movable by the valve actuator to any one of a plurality of angular positions relative to the first outlet passage in a particularly preferred embodiment of the present invention. Second and third sensors can be connected in signal communication with a controller and located to sense second and third parameters, respectively, of the marine vessel. The controller can use the first, second, and third sensor signals in combination with each other to determine the desirable position of the valve within the inlet passage of the conduit assembly.

In a particularly preferred embodiment of the present invention, at least one of the sensors is a sound level sensor attached to the marine vessel in order to sense the sound level of the exhaust system at a representative location on the marine vessel. Within the scope of the present invention, alternative methods can be used to move the valve in response to various sensor signals. For example, the valve can be movable to a fully closed position within the first outlet passage to inhibit the flow of exhaust through the first outlet passage when the first signal is greater than a preselected threshold magnitude. In this type of application, the valve actuator can be a binary type of device, such as a pneumatic cylinder, in which the valve is either fully open or fully closed. Alternatively, if the valve actuator is a stepper motor or another type of device that can selectively move the valve to any one of a plurality of positions, the valve can be moved in response to various magnitudes of noise level so that the exhaust gases can be directed in such a way to maintain the noise level below a preselected threshold magnitude.

BRIEF DESCRIPTION OF THE DRAWINGS

The present invention will be more fully and completely understood from a reading of the description of the preferred embodiment in conjunction with the figures, in which.

DESCRIPTION OF THE PREFERRED EMBODIMENT

Figure 1:
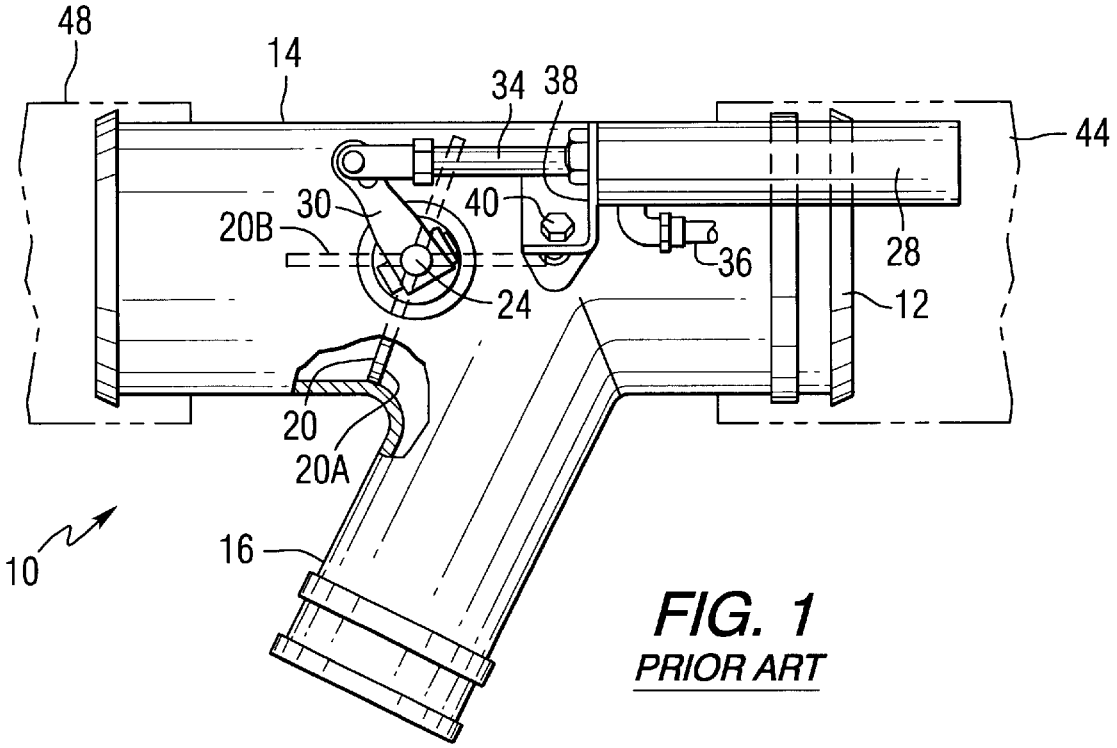
FIG. 1 PRIOR ART
FIGS. 1, 2 and 3 show prior art exhaust stream diverters.

Throughout the description of the preferred embodiment of the present invention, like components will be identified by like reference numerals.

FIG. 1 shows a known conduit assembly 10 that comprises an inlet passage 12, a first outlet passage 14 and a second outlet passage 16. A valve 20 is disposed within the first outlet passage 14 and is movable, about axis 24, to a first position 20A and a second position 20B. When in the first position 20A, flow is inhibited from passing through the first outlet passage 14 and is completely directed from the inlet passage 12 to the second outlet passage 16. The purpose of this diversion of fluid flow will be described in greater detail below in conjunction with FIG. 3.

Figure 2:
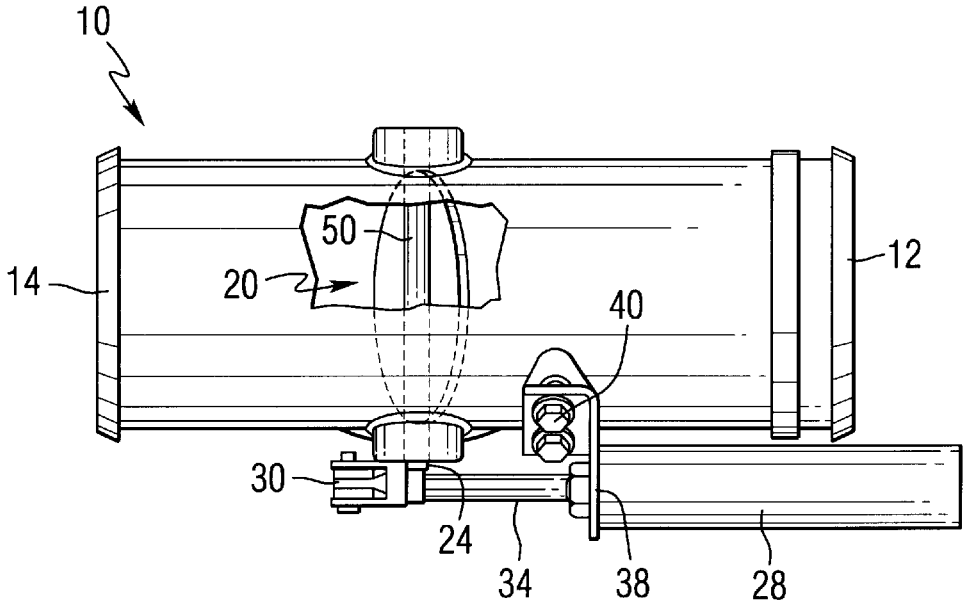
FIG. 2 PRIOR ART

With continued reference to FIG. 1, a valve actuator 28 is connected to a link 30 that causes the valve 20 to rotate about axis 24 in response to movement of piston rod 34 relative to the valve actuator 28. In FIG. 1, the valve actuator 28 is an air cylinder provided with pressurized air through conduit 36. A bracket 38 is attached to the conduit assembly 10 by a bolt 40. The inlet passage 12 is connectable to an exhaust conduit 44 of an engine and the first outlet passage 14 is connectable to a first conduit 48 that will be described in greater detail below. FIG. 2 is another view of the conduit assembly 10 showing the straight portion of the conduit assembly 10 that provides both the first outlet passage 14 and the inlet passage 12. The valve 20 is shown through a cutaway portion of the conduit assembly 10. Valve 20 rotates about the axis 24 that is provided by shaft 50. FIG. 2 also shows the relationship between the valve 20 and the link 30 which is attached to rod 34 of the valve actuator 28. Systems of this type are available in commercial quantities from the Mercury Marine division of the Brunswick Corporation and identified by numbers 15786A2 and 16645A2.

Figure 3:
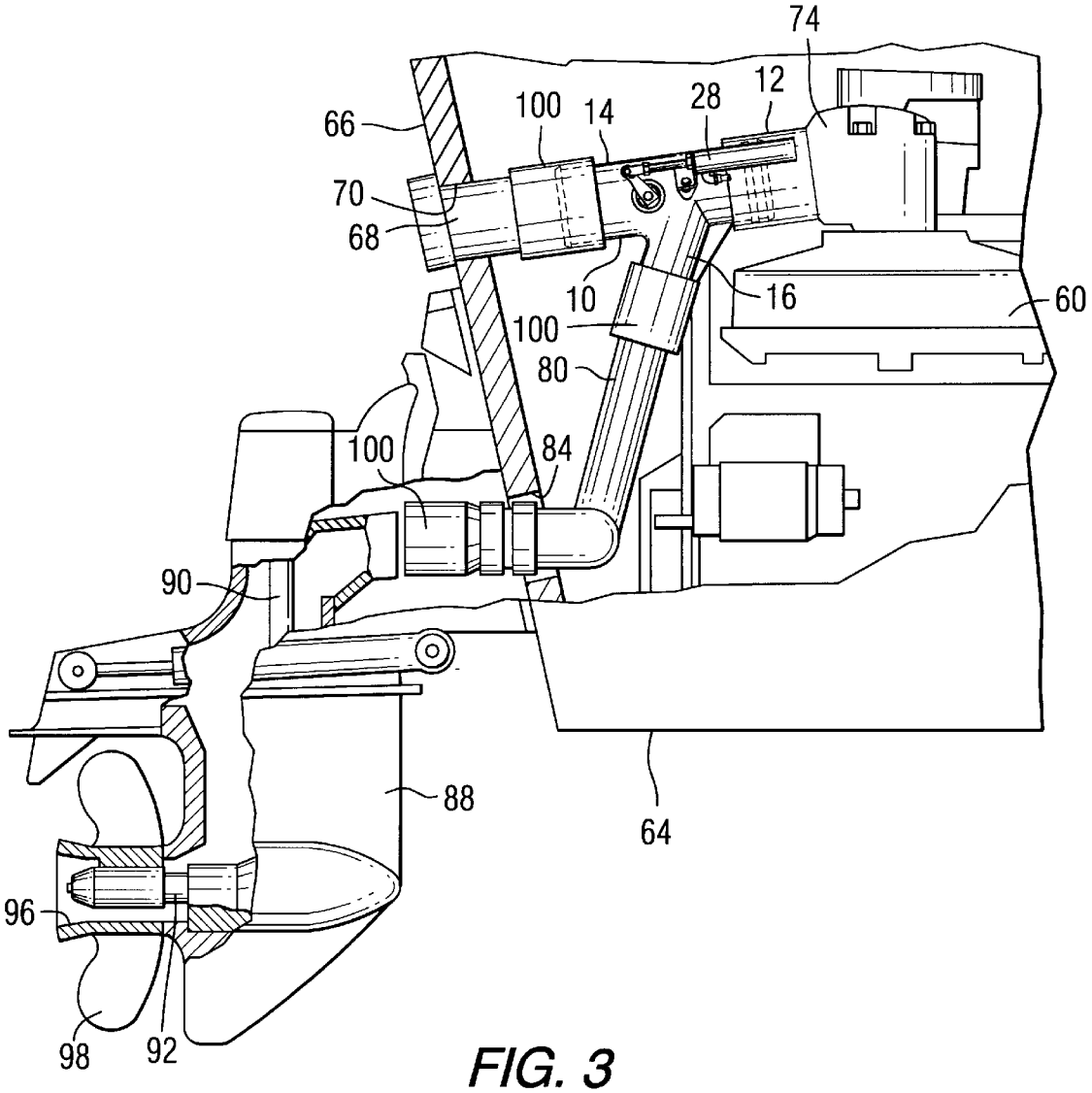
FIG. 3 PRIOR ART

FIG. 3 shows a conduit assembly 10 in association with an exhaust system of an engine 60 of a marine propulsion system. A marine vessel 64 has a transom 66 through which a first conduit 68 extends as shown in FIG. 3. The first conduit 68 extends through a hole 70 formed in the transom 66 to provide a direct flow path for exhaust emanating from an exhaust manifold 74 of the engine 60 through the transom 66 and to the atmosphere. The second outlet 16 provides a flow path from the inlet passage 12 to a second conduit 80 which directs the flow of exhaust gases from the exhaust manifold 74 through a hole 84 in the transom 56 and through conduits formed in the outboard drive 88 which is supported by the transom 66. The outboard drive 88 houses a drive shaft 90 that is connected in torque transmitting relation with a propeller shaft 92 to which a propeller is attached for rotation. The propeller comprises a hub 96 on which a plurality of blades 98 are attached. Also shown in FIG. 3 are several couplings which connect the various exhaust conduits to other conduits.

With continued reference to FIG. 3, the valve actuator 28 is shown attached to the conduit assembly 10 along with its associated components described above in conjunction with FIGS. 1 and 2. The components illustrated in FIGS. 1, 2 and 3 are generally well known to those skilled in the art and are described in greater detail in U.S. Pat. No. 4,773,215 which is described above.

With reference to FIG. 3, it should be understood that when exhaust is caused to flow from the exhaust manifold 74 through the outboard drive 88, less noise emanates from the exhaust system than when exhaust is alternatively directed partially or completely through the first outlet passage 14 and directly to the atmosphere above the water level. The greater magnitude of noise emanating from the exhaust system when the exhaust is discharged through the first conduit 68 is accompanied by reduced restriction on the exhaust flow which generally results in improved efficiency of the engine 60. The use of the conduit assembly 10 and its associated valve allows the vessel operator to selectively direct the exhaust flow through either the first outlet passage 14 or the second outlet passage 16. This, in turn, allows the marine vessel operator to select a quieter operation of the marine propulsion system or a louder, but more efficient, operation of the marine propulsion system.

Figure 4:
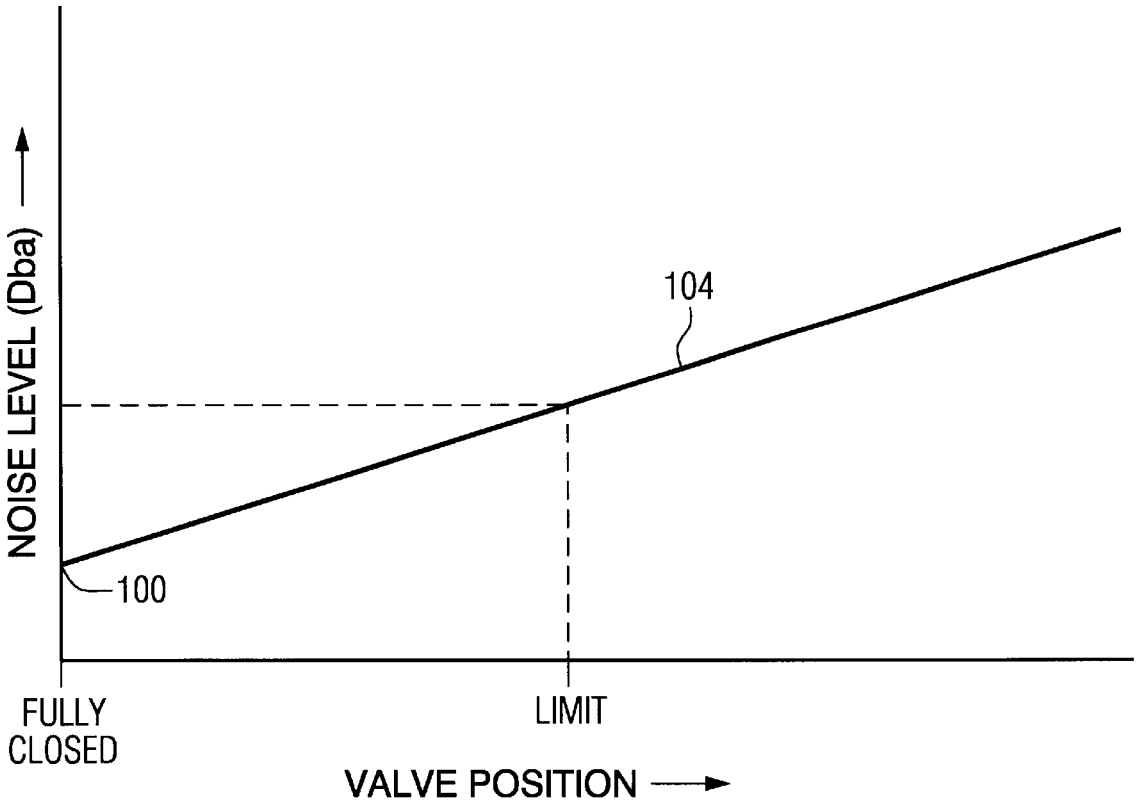
FIG. 4 shows a hypothetical relationship between sound emanating from an exhaust system and the position of the valve within the exhaust conduit assembly.

FIG. 4 shows a highly schematic and hypothetical graphical relationship between the noise level emanating from the exhaust system and the position of the valve 20. When the valve is fully closed, such as at point 100, the noise of the exhaust system is at its lowest magnitude, for any particular set of circumstances including engine speed (RPM) and intake manifold pressure. As the valve 20 is moved toward a filly opened position, the noise increases in magnitude. Although represented by a straight line 104 in FIG. 4, it should be understood that the relationship between valve position and noise level is not truly linear. The purpose of FIG. 4 is simply to illustrate that as the valve 20 opens to allow more exhaust flow through the first outlet passage 14, the noise emanating from the exhaust system increases. This occurs because more exhaust flow is allowed to pass directly through the transom 66 into the atmosphere and less exhaust flow is required to flow downward through the second outlet passage 16 to an underwater and quieter discharge point. It is important to understand the general relationship between the position of the valve 20 and the noise emanating from the exhaust system in order to fully understand the problems with known diverter systems and to also fully understand the advantages provided by the present invention.

Figure 5:
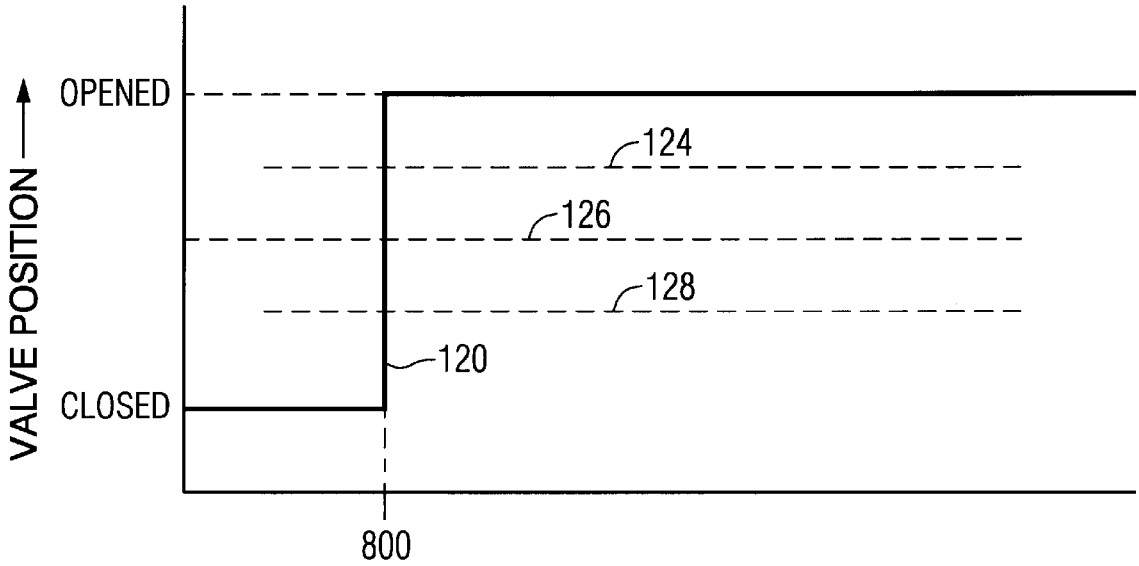
FIGS. 5 and 6 show two possible relationships between valve position and engine speed.

FIG. 5 shows one possible result of a simplified control scheme employing the present invention. In FIG. 5, the valve position is graphically represented by line 120 as a function of engine speed (RPM). Up to a preselected magnitude of engine speed, such as 800 RPM, the valve is maintained in a fully closed position to force all exhaust gases to flow to an underwater discharge point, such as through the propeller hub 96. This minimizes the noise emanating from the exhaust system and is preferable for use in situations when the marine vessel is being operated near docks, piers, and other places where loud noise may disturb other people in the nearby vicinity. It is also assumed that, under these conditions, the operator of a marine vessel will control the speed of the marine vessel to a magnitude less than or equal to the preselected idle speed identified in FIG. 5. At engine speeds above the preselected limit 120, the valve position is moved from fully closed to fully opened. This results in a rapidly increased noise magnitude from the exhaust system. However, it must be realized that even when the marine vessel is not in close proximity to docks, piers, and other areas where other people are located, certain state laws prohibit the operation of a marine propulsion system when that propulsion system emits noise above a predefined legal limit. In the time period from 1997 to 1999, most states of the United States have enforced noise limits on marine vessels. Although the state laws varied from one state to another, it was typical for the states to impose noise limitations that varied between approximately 70 dBA to approximately 90 dBA when tested according to prescribed testing procedures, such as SAE-J34, SAE-J1970, or SAE-J2005. These various testing procedures prescribe certain methodologies and parameters that should be followed when performing the tests. Given these circumstances, a marine vessel operator could possibly violate state or local ordinances when manually switching from the underwater discharge point, through the second outlet passage 16, to an above water discharge point through the first exhaust passage 14. If the increase in noise level emanating from the exhaust system exceeds the legal limit, the operator of the marine vessel would be subject to legal penalties. The present invention is intended to reduce the likelihood of that disadvantageous result.

Each marine propulsion system and boat combination can be empirically tested to determine the noise level emanating from the exhaust system when the exhaust is fully diverted through an above water discharge point. The engine speed associated with that noise level can be calibrated and a controller, such as an engine control unit (ECU), can continuously monitor engine speed and manipulate the position of the valve 20 to assure that the engine speed does not reach a magnitude that causes an excessive noise from the exhaust system. This self governing limit can be programmed into the engine control unit to suit any particular state in which the marine propulsion system is operated. Alternatively, a manually selectable threshold can be provided, such as with DIP switches or fusible links, in which the maximum noise threshold can be changed if the marine vessel is moved from state to state or when state laws change. The engine control unit can easily compare the programmed noise level limit with a predetermined relationship between engine speed and noise level and then control the movement of the valve 20 as a function of engine speed to assure that the legal noise threshold is not exceeded. As an example, in FIG. 5, several horizontal dashed lines are shown. These dashed lines represent various degrees of valve opening that could be provided as noise related limits used by the engine control unit. For example, dashed line 124 may represent a valve position which is the maximum opening allowable based on an empirically determined relationship between engine speed and noise emanating from the exhaust system. Dashed lines 126 and 128 represent alternative positions determined by their associated noise levels.

With continued reference to FIG. 5, it should be understood that the graphical representation is associated with a system in which only two positions for the valve 20 are possible. For example, if an air cylinder is used to actuate the movement of the valve 20, it can only be moved from one maximum opened position to an opposite maximum closed position. The engine control unit would have to be provided with some other means if it is to select a position other than the maximum allowable position. Otherwise, the valve would always be moved to a fully opened position when the valve actuator is energized. This greater flexibility in valve position selection can be provided if a stepper motor is used as the valve actuator 28 instead of the air cylinder described above in conjunction with FIGS. 1, 2, and 3.

Figure 6:
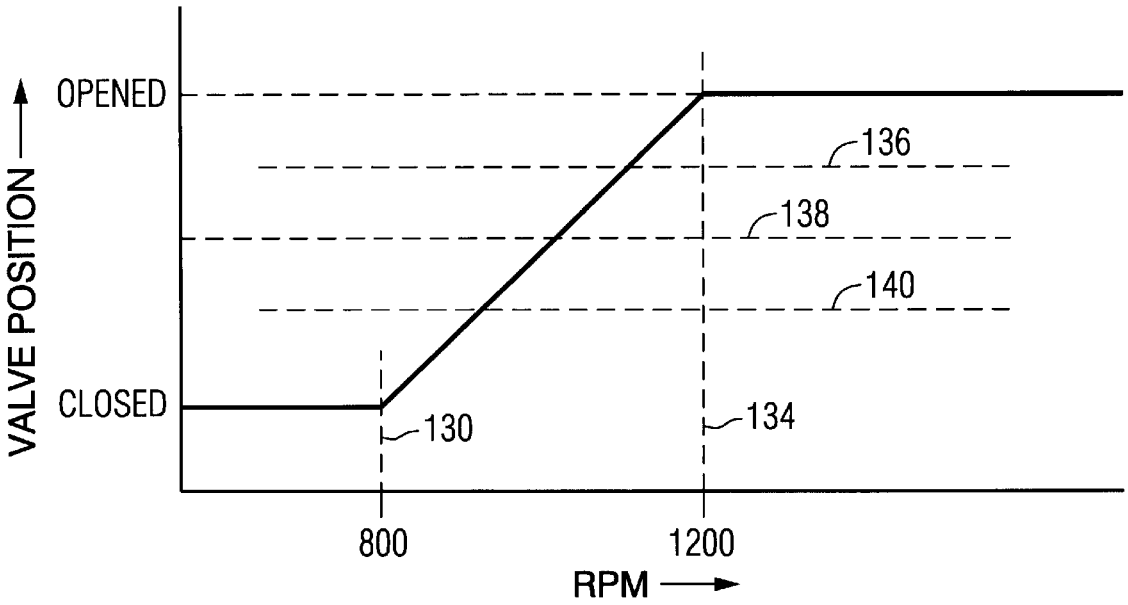

FIG. 6 is generally similar to FIG. 5, but the opening of the valve 20 is governed by the engine control unit (ECU) in a way that the degree of opening of the valve is proportional to the engine speed between a minimum speed 130 and a fully opened speed 134. In other words, when the engine is operated at a speed below 800 RPM, the valve position is maintained in a fully closed position to achieve a minimum noise level emanating from the exhaust system. Above this threshold 130, the valve is opened as a function of engine speed until it reaches a fully opened position, represented by dashed line 134, at an engine speed of 1200 RPM. Above that, the engine RPM can increase but the valve is not able to open beyond its fully opened position. As in the examples described above in conjunction with FIG. 5, other valve positions can be governed by other criteria so that the valve position is limited to degrees of opening represented by dashed lines 136, 138, and 140.

With reference to FIGS. 5 and 6, it should be understood that the limits represented by dashed lines 124, 126, 128, 136, 138, and 140, can be selected based on several alternative parameters. For example, if a noise level sensor is provided on or near the transom 66 of the marine vessel 64, the actual noise level can be measured and dynamically compared to the legal limit as the marine propulsion system is operated by the vessel operator. Regardless of the throttle position commanded by the operator and regardless of the valve 20 position determined by the engine control unit, the valve movement can be limited when the noise level sensor senses a magnitude of noise greater than a preset allowed threshold magnitude. This would not directly limit the engine speed commanded by the operator but, instead, would limit the amount of exhaust that can be diverted through the first outlet passage 14 by the valve 20. In other words, at engine speeds that would otherwise cause an excessive noise to emanate from the exhaust system, the engine control unit closes or partially closes the valve 20 to force the exhaust to an underwater discharge point in order to limit the noise created by the marine propulsion system. If necessary, the valve 20 would be fully closed to force all of the exhaust through the propeller hub 96 and allow none of the exhaust to pass directly through the transom 66 and the first conduit 68. This system allows the boat operator to manually select the engine speed and allow the engine control unit to automatically select an appropriate valve 20 position, but exerts an overriding control over the system so that any commands by either the operator or the engine control unit that normally would result in excessive noise emanating from the marine propulsion system would cause the valve 20 to be closed or partially closed until the resulting noise level is reduced to an acceptable one at or below the legal limits.

Figure 7:
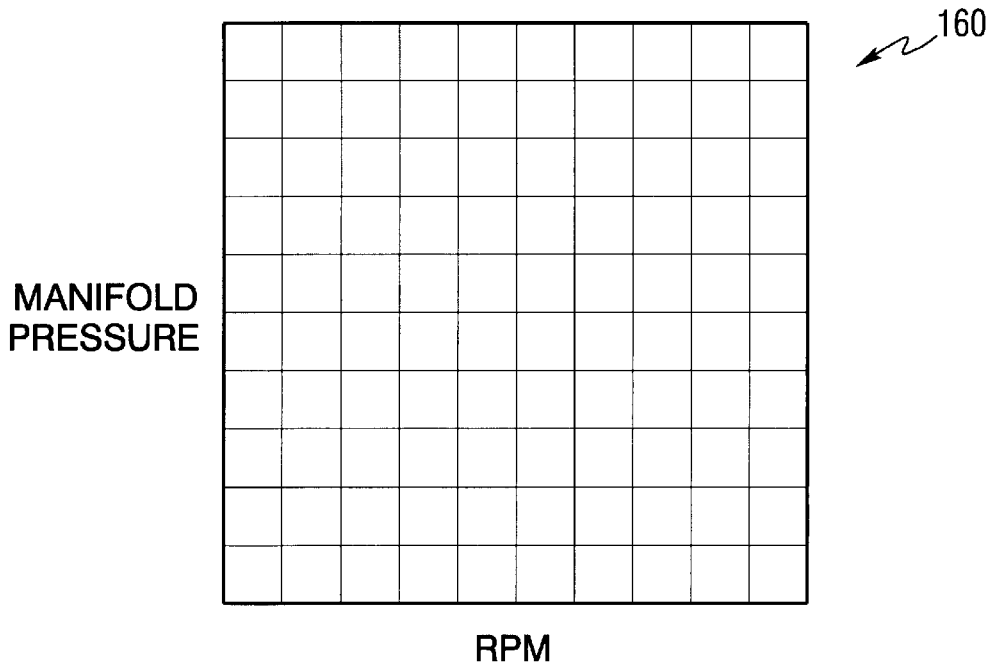
FIG. 7 shows a MAP that determines valve position as a dual function of manifold pressure and engine speed.

FIG. 7 is an alternative embodiment of the present invention that uses a map 160 that is, in effect, a two dimensional table stored in the memory of the engine control unit (ECU). In the exemplary map shown in FIG. 7, one hundred digital values would be stored as a function of ten discrete manifold pressure magnitudes and ten discrete engine speeds. For each combination of a particular manifold pressure and engine speed, a specific valve position is stored. The engine control unit continually measures manifold pressure and engine speed and selects an appropriate valve 20 position. A stepper motor can be used to move the valve to the desired position represented in the matrix shown in FIG. 7. As described above, the overriding parameter can be applied to limit the valve position as a function of the noise that the exhaust system is creating. Therefore, regardless of the valve position represented in the matrix of FIG. 7, a sound level sensor can be used to further the limit the opening of the valve 20 so that the noise emanating from the exhaust system does not exceed legal limits.

Figure 8:
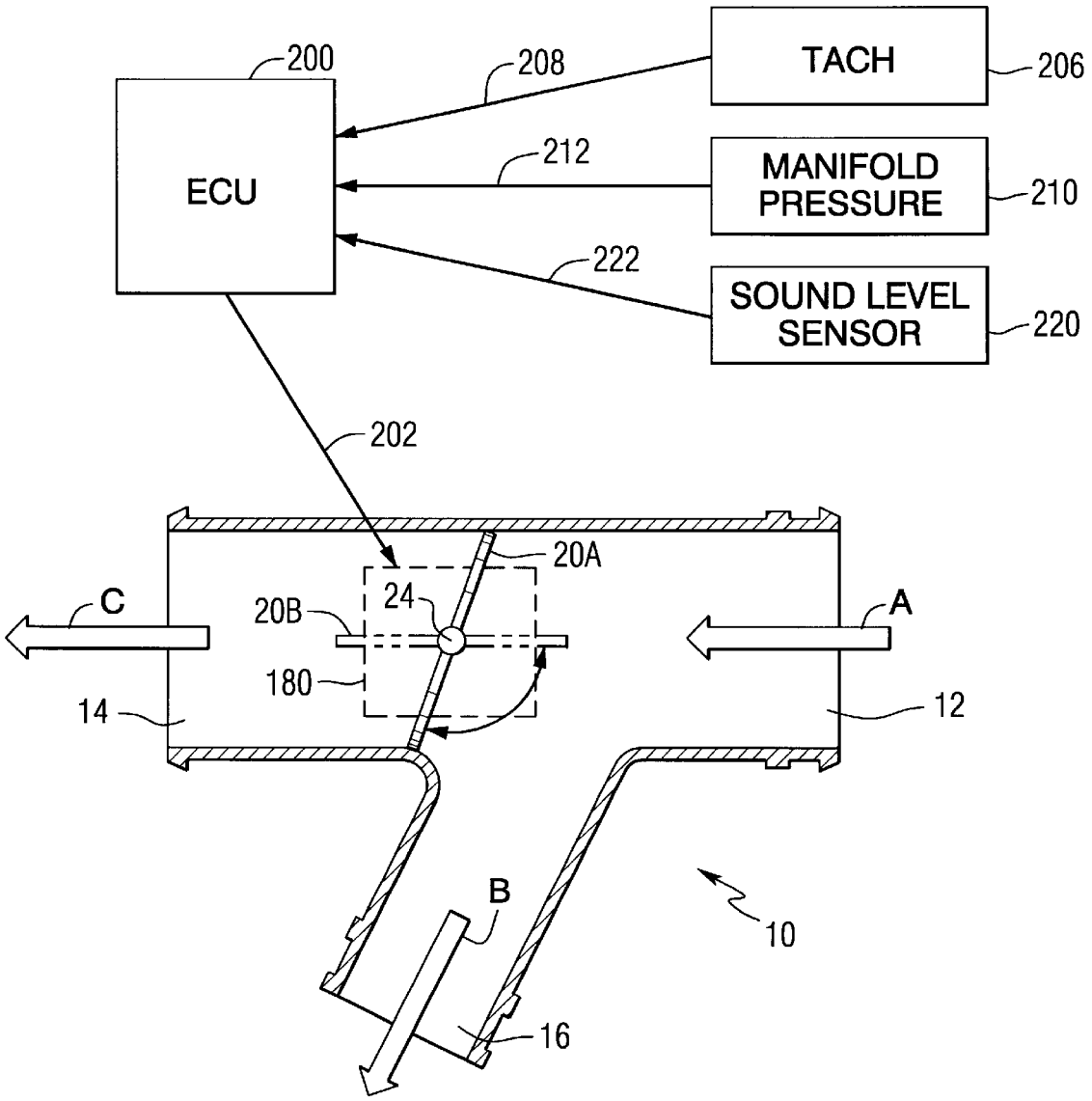
FIG. 8 is a highly schematic representation of the present invention.

FIG. 8 shows a conduit assembly 10 with an inlet passage 12, a first outlet passage 14 and a second outlet passage 16, represented in a simplified schematic illustration. The valve 20 is shown in a fully closed position 20A and a fully opened position 20B. As described above, when the valve 20 is in the fully closed position 20A, all of the exhaust flow from the engine flows along the path represented by arrows A and B and is discharged under water through the propeller hub 96. When the valve 20 is in the fully opened position 20B, the exhaust flow from the engine follows the path represented by arrows A and C and is discharged into the atmosphere directly through the transom 66. If a stepper motor 180 is used as the valve actuator 28, described above in conjunction with an air cylinder in FIGS. 1, 2, and 3, the valve 20 can be placed at any one of a plurality of possible positions relative to the first outlet passage 14. In FIG. 8, an engine control unit 200 provides a signal to the stepper motor 180, as represented by arrow 202, which commands the stepper motor 180 to move the valve 20 to a preselected position. The engine control unit 200 can make the position related decision based on various inputs received from various sensors. For example, the engine speed can be measured by a tachometer 206 and provided to the engine control unit 200 as represented by arrow 208. The manifold pressure can be detected by a pressure sensor 210 and provided to the engine control unit 200 as represented by arrow 212. A sound level sensor 220 can provide a signal to the engine control unit 200, as represented by arrow 222, which is representative of the sound level at the location of the sound level sensor. These three variables can be manipulated by the engine control unit 200 to determine the appropriate position of the valve 20. As described above, a preferred embodiment of the present invention would use a first sensor signal, such as the engine speed provided by the tachometer 206, and control the valve position in a manner that is generally represented in FIG. 6. The signal received from the sound level sensor 220 would be used as an overriding limit for the movement of the valve 20. In other words, regardless of the valve position determined by the engine control unit based on engine speed, the signal received from the sound level sensor would prevent the valve 20 from being opened beyond an angle that would exceed the noise level from the exhaust system prescribed by state or local laws.

Figure 9:
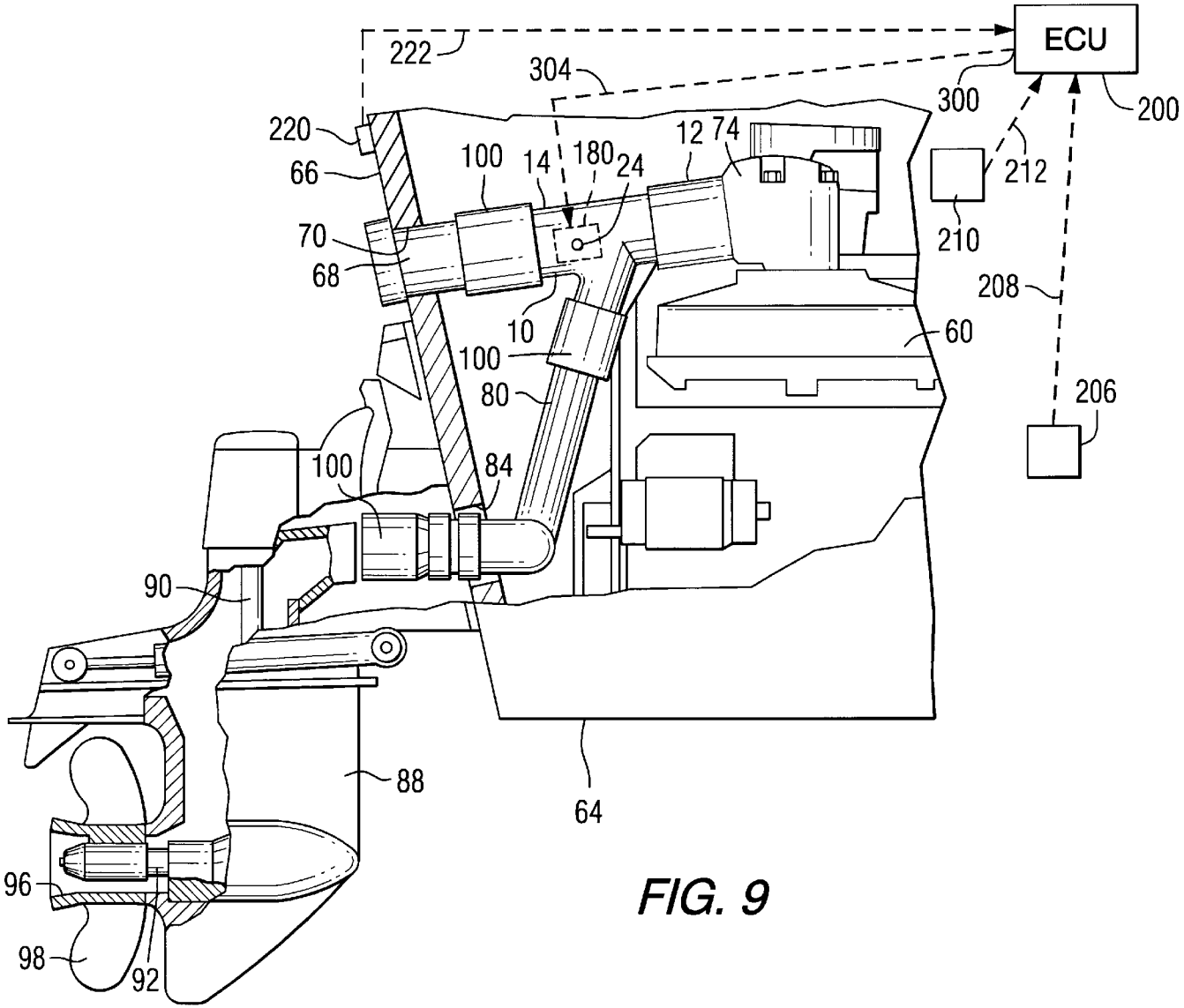
FIG. 9 is a section view of a marine propulsion system in a marine vessel which employs the present invention.

FIG. 9 shows an embodiment of the present invention in which an engine control unit 200 is provided with a tachometer 206 to measure the operating speed of the engine 60, a pressure sensor 210 to measure manifold pressure at the intake of the engine 60, and a sound level sensor 220 to measure the intensity of noise at a particular area, such as the transom 66 of the marine vessel 64. These three sensors provide their signals to the engine control unit 200 on lines 208, 212, and 222 as described above in conjunction with FIG. 8. The stepper motor 180 controls the position of the valve 20 (not shown in FIG. 9) about its axis of rotation 24.

As described above in conjunction with FIGS. 5, 6, and 7, the engine control unit 200 can command various positions for the valve actuator, such as the stepper motor 180, to move the valve 20 (not shown in FIG. 9) based on inputs received from the sensors. The engine control unit 200 is provided with an output signal port 300 from which a signal is provided to the stepper motor 180, as represented by dashed line 304 in FIG. 9. Therefore, the engine control unit 200 continually receives signals from various sensors which are measuring various parameters and uses those input signals to determine the most advantageous position of the valve 20 within the conduit assembly 10. As long as the sound level sensor 220 provides a signal to the engine control unit 200 that the sound level is below a preselected limit (e.g. the legal limit), the engine control unit 200 can move the valve 20 to any location which is typically determined as a function of engine speed measured by the tachometer 206 or manifold pressure measured by the pressure sensor 210, or both in combination with each other. As the marine vessel operator changes speed of the marine vessel, the distribution of exhaust gases will be controlled by the valve 20. However, if the sound level sensor 220 detects a sufficient increase in noise emanating from the exhaust system to indicate a violation of state or local ordinances, as preset by the marine vessel operator or marine vessel dealer, the engine control unit 200 limits further opening of the valve 20 and, if necessary, closes or partially closes the valve 20 to reduce the sound level to a magnitude that is below the preselected limit.

As described above, the exhaust control system of the present invention is intended for a marine vessel having an inboard engine 60, an outboard drive mechanism 88, and a transom 66. It comprises a conduit assembly 10 that, in turn, comprises an inlet passage 12, a first outlet passage 14, and a second outlet passage 16. A valve 20 is disposed within the conduit assembly 10 for selectively blocking the first outlet passage 14 from fluid communication with the inlet passage 12. A valve actuator 28, such as an air cylinder or a stepper motor 180, is connected to the valve 20 for controlling the position of the valve 20 relative to the first outlet passage 14. A controller, such as the engine control unit 200, has an output signal port 300 that is connected in signal communication with the valve actuator 28. The present invention further comprises a first sensor, such as the tachometer 206, the manifold pressure sensor 210, or the sound level sensor 220, that is connected in signal communication with the controller 200 and located to sense a first parameter, such as engine speed, intake manifold pressure or sound level of the exhaust system, respectively. The first sensor provides a first sensor signal to the controller 200 which is representative of the first parameter, with the valve 20 being movable to a position within the first outlet passage 14 by the valve actuator 28 in response to the first output signal provided on line 304 by the engine control unit 200 as a function of the first sensor signal.

As also described above, the inlet passage 12 is connectable to an exhaust conduit of the engine 60, the first outlet passage 14 is connectable to a first conduit 68 extending directly through the transom 66 to the atmosphere, and the second outlet passage 16 is connectable to a second conduit 80 which extends through the transom 66 and through the outboard drive mechanism 88. The valve 20 is a butterfly valve in a preferred embodiment of the present invention and the valve actuator 28 is a stepper motor 180. Although the valve can be of a type which is movable only to one of two extreme positions, fully opened or fully closed, it is preferable to employ a system in which the valve 20 can be moved to any one of a plurality of positions so that the engine control unit 200 can more accurately and precisely regulate the noise level emanating from the exhaust system.

In a simplified embodiment of the present invention, a single sensor can be used for these purposes and the single sensor can be the sound level sensor 220. However, particularly preferred embodiments of the present invention utilize other sensors, such as the tachometer 206 to provide engine speed signals to the engine control unit 200 with which the engine control unit determines a desired position of the valve 20. The sound level sensor is preferably used as a second sensor providing a second signal to the engine control unit 200 which is used as an upper threshold limit for the position of the valve 20, regardless of the magnitude of the other sensor signal (e.g. engine speed). This allows the engine control unit 200 to avoid any combination of parameters that would otherwise cause the sound emanating from the exhaust system to exceed preselected thresholds. Those skilled in the art will appreciate that sound level can be measured in many different ways. Sound pressure level (SPL) is a term that is often used in measuring the magnitude of sound. It is a relative quantity in that it is the ratio between the actual sound pressure and a fixed reference pressure. This reference pressure is usually that of the threshold of hearing which has been internationally agreed upon as having the value 0.0002 dynes/cm$^2$. Sound pressure level may be measured with a sound level meter that is weighted according to a specific frequency response pattern and termed the sound level. The electroacoustic equivalent to the sound pressure level is measured with a VU meter. Because the square of the sound pressure is proportional to sound intensity, the sound pressure level can be calculated in a similar manner and is measured in decibels (dBA). A VU meter is a device for measuring the level of sound intensity with audio equipment, such as amplifiers and tape recorders. The expression "VU" is an abbreviation of volume unit. Although the measurements indicated on such a meter are measured in decibels, the zero level should not be confused with 0.0 dB, which is the threshold of hearing. On such meters, zero typically indicates the maximum distortion-free level that can be handled by the device with other values greater or less than the zero level indicated as positive and negative decibels relative to it respectively. The decibel (dB) is a unit of a logarithmic scale of power or intensity called the power level or intensity level. The decibel is defined as one tenth of a bel where one bel represents a difference in level between two intensities, where one is ten times greater than the other.

Sound level meters are available in many different forms. Various types of meters are available in commercial quantities from Action-Electronics, Radio Shack, Kernco Instruments Company and other suppliers. Also, various types of sound level meters on a single ship can be provided for standard analog meters. Various sources of these circuits are well known to those skilled in the art. The precise type and position of the sound level sensor used in association with the present invention is not limiting to its scope.

Although the present invention has been described with particular specificity and illustrated to show a preferred embodiment, it should be understood that alternative embodiments are also within its scope.

What is claimed is:

1. In a marine vessel having an inboard engine, an outboard drive mechanism, and a transom, an exhaust control system, comprising:

a conduit assembly comprising an inlet passage, a first outlet passage, and a second outlet passage;

a valve disposed within said conduit assembly for selectively blocking said first outlet passage from fluid communication with said inlet passage;

a valve actuator connected to said valve for controlling the position of said valve relative to said first outlet passage;

a controller having an output signal port connected in signal communication with said valve actuator; and a first sensor connected in signal communication with said controller and located to sense a first parameter of said marine vessel, said first sensor providing a first sensor signal to said controller which is representative of said first parameter, said valve being movable to a position within said first outlet passage by said valve actuator in response to a first output signal provided by said controller at said output signal port as a function of said first sensor signal, said first sensor being a sound level sensor attached to said marine vessel to sense the sound level of said exhaust system at a representative location on said marine vessel, said first sensor signal being representative of the sound level of said exhaust system at said representative location on said marine vessel, said valve being movable to a position within said first outlet passage to inhibit the flow of exhaust through said first outlet passage to a degree necessary to maintain the magnitude of said first sensor signal below a preselected threshold magnitude.

2. The system of claim 1, wherein:

said inlet passage is connectable to an exhaust conduit of said engine.

3. The system of claim 1, wherein:

said first outlet passage is connectable to a first conduit extending directly through said transom.

4. The system of claim 1, wherein:

said second outlet passage is connectable to a second conduit extending through said transom and through said outboard drive mechanism.

5. The system of claim 1, wherein:

said valve is a butterfly valve.

6. The system of claim 1, wherein:

said valve actuator is a stepper motor.

7. The system of claim 1, wherein:

said valve is movable by said valve actuator to any one of a plurality of angular positions relative to said first outlet passage.

8. The system of claim 1, further comprising:

a second sensor connected in signal communication with said controller and located to sense a second parameter of said marine vessel, said second sensor providing a second sensor signal to said controller which is representative of said second parameter, said valve being movable to a position within said first outlet passage by said valve actuator in response to said first output signal provided by said controller at said output signal port as a combined function of said first and second sensor signals.

9. The system of claim 8, further comprising:

a third sensor connected in signal communication with said controller and located to sense a third parameter of said marine vessel, said third sensor providing a third sensor signal to said controller which is representative of said third parameter, said valve being movable to a position within said first outlet passage by said valve actuator in response to said first output signal provided by said controller at said output signal port as a combined function of said first, second, and third sensor signals.

10. The system of claim 1, wherein:

said first sensor is a sound level sensor attached to said marine vessel to sense the sound level of said exhaust system at a representative location on said marine vessel, said first sensor signal being representative of the sound level of said exhaust system at said representative location on said marine vessel, said valve being movable to a fully closed position within said first outlet passage to inhibit the flow of exhaust through said first outlet passage when said first sensor signal is greater than a preselected threshold magnitude.

11. The system of claim 1, wherein:

said second outlet passage is connectable to a second conduit extending through said transom and conducting exhaust gasses to an underwater emission location.

12. In a marine vessel having an inboard engine, an outboard drive mechanism, and a transom, an exhaust control system, comprising:

a conduit assembly comprising an inlet passage, a first outlet passage, and a second outlet passage, said inlet passage being connectable to an exhaust conduit of said engine, said first outlet passage being connectable to a first conduit extending directly through said transom, said second outlet passage being connectable to a second conduit extending through said transom and through said outboard drive mechanism;

a valve disposed within said conduit assembly for selectively blocking said first outlet passage from fluid communication with said inlet passage;

a valve actuator connected to said valve for controlling the position of said valve relative to said first outlet passage;

a controller having an output signal port connected in signal communication with said valve actuator;

a first sensor connected in signal communication with said controller and located to sense a first parameter of said marine vessel, said first sensor providing a first sensor signal to said controller which is representative of said first parameter, said valve being movable to a position within said first outlet passage by said valve actuator in response to a first output signal provided by said controller at said output signal port as a function of said first sensor signal; and a second sensor connected in signal communication with said controller and located to sense a second parameter of said marine vessel, said second sensor providing a second sensor signal to said controller which is representative of said second parameter, said valve being movable to a position within said first outlet passage by said valve actuator in response to said first output signal provided by said controller at said output signal port as a combined function of said first and second sensor signals, said second sensor being a sound level sensor attached to said marine vessel to sense the sound level of said exhaust system at a representative location on said marine vessel, said second sensor signal being representative of the sound level of said exhaust system at said representative location on said marine vessel, said valve being movable to a fully closed position within said first outlet passage to inhibit the flow of exhaust through said first outlet passage when said second sensor signal is greater than a preselected threshold magnitude.

13. The system of claim 12, wherein:

said valve is a butterfly valve and said valve actuator is a stepper motor.

14. The system of claim 13, wherein:

said valve is movable by said valve actuator to any one of a plurality of angular positions relative to said first outlet passage.

15. In a marine vessel having an inboard engine, an outboard drive mechanism, and a transom, an exhaust control system, comprising:

a conduit assembly comprising an inlet passage, a first outlet passage, and a second outlet passage;

a valve disposed within said conduit assembly for selectively blocking said first outlet passage from fluid communication with said inlet passage;

a valve actuator connected to said valve for controlling the position of said valve relative to said first outlet passage;

a controller having an output signal port connected in signal communication with said valve actuator;

a first sensor connected in signal communication with said controller and located to sense a first parameter of said marine vessel, said first sensor providing a first sensor signal to said controller which is representative of said first parameter, said valve being movable to a position within said first outlet passage by said valve actuator in response to a first output signal provided by said controller at said output signal port as a function of said first sensor signal; and a second sensor connected in signal communication with said controller and located to sense a second parameter of said marine vessel, said second sensor providing a second sensor signal to said controller which is representative of said second parameter, said valve being movable to a position within said first outlet passage by said valve actuator in response to said first output signal provided by said controller at said output signal port as a combined function of said first and second sensor signals, said second sensor being a sound level sensor attached to said marine vessel to sense the sound level of said exhaust system at a representative location on said marine vessel, said second sensor signal being representative of the sound level of said exhaust system at said representative location on said marine vessel, said valve being movable to a position within said first outlet passage to inhibit the flow of exhaust through said first outlet passage to a degree necessary to maintain the magnitude of said first sensor signal below a preselected threshold magnitude.

16. The system of claim 15, wherein:

said inlet passage is connectable to an exhaust conduit of said engine, said first outlet passage is connectable to a first conduit extending directly through said transom, and said second outlet passage is connectable to a second conduit extending through said transom and through said outboard drive mechanism.

* * * * *